US006527517B1

(12) United States Patent
Wallrafen et al.

(10) Patent No.: US 6,527,517 B1
(45) Date of Patent: Mar. 4, 2003

(54) PUMP

(75) Inventors: Werner Wallrafen, Hofheim (DE); Klaus Bluhm, Steinbach (DE)

(73) Assignee: Mannesmann VDO AG, Frankfurtam Main (DE)

( * ) Notice: Subject to any disclaimer, the term of this patent is extended or adjusted under 35 U.S.C. 154(b) by 0 days.

(21) Appl. No.: 09/659,960

(22) Filed: Sep. 12, 2000

(30) Foreign Application Priority Data

Sep. 13, 1999 (DE) ..... 199 43 581
Aug. 3, 2000 (DE) ..... 100 38 550

(51) Int. Cl.[7] ..... F04B 49/10
(52) U.S. Cl. ..... 417/32
(58) Field of Search ..... 417/32, 1

(56) References Cited

U.S. PATENT DOCUMENTS 3,911,943 A * 10/1975 Athey et al. ..... 137/341
4,265,603 A * 5/1981 Chiyoda et al. ..... 418/2
4,406,158 A * 9/1983 Allington ..... 73/61.57
4,718,824 A * 1/1988 Cholet et al. ..... 417/14
4,836,147 A * 6/1989 Morris ..... 123/41.44
5,141,402 A * 8/1992 Bloomquist et al. ..... 417/5
5,158,436 A * 10/1992 Jensen et al. ..... 417/32
5,166,990 A * 11/1992 Riccitelli et al. ..... 6/12
5,525,039 A * 6/1996 Sieghartner ..... 417/32
5,579,739 A * 12/1996 Tuckey et al. ..... 123/467
5,655,839 A * 8/1997 Schmidt et al. ..... 374/132
5,772,403 A * 6/1998 Allison et al. ..... 417/44.2
5,808,441 A * 9/1998 Nehring ..... 318/751
5,829,475 A * 11/1998 Acker ..... 137/337
5,868,175 A * 2/1999 Duff et al.
5,971,713 A * 10/1999 North, Jr. ..... 417/36
6,000,912 A * 12/1999 Takada et al. ..... 417/32
6,017,337 A * 1/2000 Pira ..... 606/20
6,085,530 A * 7/2000 Barito ..... 62/126
6,301,090 B1 * 10/2001 Mack ..... 361/25

FOREIGN PATENT DOCUMENTS

AU 318 857 10/1972 ..... F04D/15/00
DE 26 56 361 6/1978 ..... F01P/7/16
DE 94 15 934.3 11/1994 ..... F04D/13/06
DE 195 39 604 4/1997 ..... F01P/5/12
DE 197 06 424 8/1998 ..... F04D/15/00

* cited by examiner

*Primary Examiner*—Teresa Walberg
*Assistant Examiner*—Daniel Robinson
(74) *Attorney, Agent, or Firm*—Cohen, Pontani, Lieberman & Pavane

(57) ABSTRACT

A pump for a coolant circuit of an internal combustion engine of a motor vehicle includes a temperature sensor integrated into the pump for detecting the temperature of the fluid flowing into a pump chamber. The temperature sensor is inserted into a recess of a pump casing of the pump. The recess produces a reduced wall thickness (d) in the region proximate the temperature sensor. The reduced wall thickness improves the heat transition through the pump casing from the fluid to the temperature sensor and reduces the outlay in terms of production. Furthermore, the temperature sensor is arranged on a carrier material common to a control of the pump so that the susceptibility of the contacting of the temperature sensor to faults is reduced.

13 Claims, 3 Drawing Sheets

PUMP

BACKGROUND OF THE INVENTION

1. Field of the Invention

The present invention relates to a pump for feeding a cooling fluid for an internal combustion engine of a motor vehicle in which a feed quantity is controlled as a function of engine operating parameters or for feeding a cleaning fluid for headlamps or shields of a motor vehicle, the pump including a temperature sensor for regulating the quantity of fluid fed by the pump.

2. Description of the Related Art

Pumps having a temperature sensor are often used in motor vehicles when the feed quantity required is dependent on the temperature. Every motor vehicle has, for example, a pump for feeding the cooling fluid. The pump is coupled fixedly to the internal combustion engine via V-belts so that the rotational speed of the pump is correspondingly coupled to the rotational speed of the internal combustion engine and fluctuates as the speed of the internal combustion engine changes. However, since the amount of heat from the internal combustion engine to be discharged by the cooling fluid varies, the cooling fluid quantity supplied to the internal combustion engine is regulated by at least one valve arranged in the cooling circuit and regulated by a temperature sensor.

In cleaning systems for headlamps or shields, the cleaning capacity of the fluid increases as the temperature of the cleaning fluid increases. Accordingly, the optimum fluid quantity presupposes that the temperature is detected as accurately as possible.

According to the prior art, a temperature sensor is inserted into a line element of the fluid circuit to detect the temperature. The measurement values obtained by this sensor are then recorded in a central control unit and evaluated to activate the pump.

A problem with the prior art devices is that the detection of the temperature is carried out often only with an unsatisfactory degree of accuracy. A complicating effect is that the exact position of the temperature detector in the line system must be known to account for adjacent heat sources and heat sinks which may influence the measurement values. Consequently, each different motor vehicle type or motor vehicle variations must take into account correction values in the activation of the pump. These correction values must be filed in a storage element. The outlay for activating such a pump is therefore comparatively high.

SUMMARY OF THE INVENTION

It is an object of the present invention to design a pump having a temperature sensor in such a way that the cooling fluid quantity can be regulated as exactly as possible for different applications and conditions of installation.

The object according to the present invention is met in that the pump and the temperature sensor are designed as an integral structural unit. By virtue of the temperature sensor being integrated according to the invention into the pump, the structural unit according to the invention is particularly cost-effective to produce and is simultaneously simple to mount in a motor vehicle. The association between the temperature sensor and the pump is determined directly so that the activation of the pump is simplified and an additional outlay for contact between the two components is avoided. Furthermore, the risk of incorrect mounting and the susceptibility to operating faults are markedly reduced.

According to an embodiment of the present invention, the pump may be used as a cooling fluid pump for the internal combustion engine of a motor vehicle. The pump according to this embodiment has an electric motor connected for driving the pump. The rotational speed of the electric motor is controlled as a function of signals from the temperature sensor. Accordingly, the temperature of the cooling fluid directly accounted for in the regulation of the feed volume, without the possibility of falsifications of measurement values due to a lengthy distance of the temperature sensor from the pump. The pump according to the present invention optimally adapts the feed volume to the respective cooling requirement. In contrast to cooling fluid pumps which are driven directly by the internal combustion engine via V-belts, the energy requirement of the pump is lower, because it always operates at the exact feed capacity required.

It is particularly beneficial embodiment of the present invention, the temperature sensor is connected on the outside of a pump casing of the pump. The arrangement of the temperature sensor on the pump casing at the same time allows a reliable detection of the temperature to be determined through the wall of the pump casing and easy exchange of the temperature sensor in the event of a fault. Since the temperature sensor is not in direct contact with the liquid to be fed, the pump may be used without difficulty with aggressive fluids.

In a further embodiment of the pump according to the present invention, the pump casing has a reduced wall thickness in the region of the temperature sensor. The transition of the heat given off by the fluid through the wall of the pump casing is thereby improved substantially so that the accuracy of the measurement values detected in this way is appreciably increased. Furthermore, the response behavior in the event of pronounced temperature fluctuations, in particular when the motor vehicle is being started up, is also improved. The improved heat transition may be additionally increased by an appropriate selection of a suitable pump casing material.

The pump casing may be provided with an outer flattened portion or else with a shaped-out portion arranged on an inner wall to achieve the reduced wall thickness at the intended position of the temperature sensor. Alternatively, the pump may include a recess in which the temperature sensor is inserted. In this alternative embodiment, the temperature sensor is separated from the fluid only by a comparatively small remaining material thickness of the wall of the pump casing. Therefore, heat losses such as those due to discharge via the surface of the pump casing are considerably restricted. At the same time, the recess allows the temperature sensor to be arranged so that it is effectively protected against damage. Accordingly, mechanical damage caused by adjacent components may be avoided.

A further benefit is achieved by arranging the temperature sensor in the region of a pump chamber of the pump. The temperature of the fluid may thereby be transmitted quickly and without additional heat conduction losses. For this purpose, the temperature sensor may be fixed, for example, on the outside to a wall of the pump chamber or else is inserted into a recess which allows direct contact between the fluid and the temperature sensor. At the same time, it is possible to have a combination of a temperature sensor designed both for determining the temperature of the fluid and for detecting the feed quantity, with the result that the outlay in terms of production is reduced and the mounting process is simplified.

In another embodiment of the present invention the temperature sensor is arranged in the region of a connecting flange of the pump. In this embodiment, the measurement values for determining the temperature of the fluid are detected directly before the fluid enters the pump chamber. This embodiment avoids possible measurement value deviations which may be caused by the pump drive transmitting extraneous heat to the fluid. The measurement values therefore have correspondingly increased accuracy.

In yet a further embodiment of the present invention, the temperature sensor may be arranged in the region of an inlet orifice of the pump chamber. This embodiment avoids possible measurement value deviations which may be caused by the pump drive transmitting extraneous heat to the fluid and additionally avoids any deviations which may arise due to heat possibly being dissipated in the connection region of a line element.

At the same time, a further-simplified embodiment of the pump according to the present invention is achieved in that the temperature sensor is combined jointly with a control of the pump in a structural unit. The temperature sensor, the essential parts of which consist of electric components, may thus be integrated expediently into the control of the pump. An additional outlay for contacting the temperature sensor is therefore avoided, and operating reliability is simultaneously increased. The temperature sensor may also be arranged, for example, on a pump circuit board common to the control, with the result that the outlay in terms of production may be reduced even further.

The temperature sensor may be connected to a carrier element produced from a ceramic material. The fixing of the temperature sensor can thereby be effected equally reliably and without the risk of damage to adjacent electric components which are therefore exposed to the heat to be detected. For this purpose, the carrier produced from the ceramic material at the same time allows good heat transmission, and the electric circuit elements can be applied in a simple way as a hybrid circuit and therefore require only a small amount of space. The insensitivity of the ceramic material to high temperatures also prevents mechanical damage to the carrier and consequently to the connection between the temperature sensor and the pump.

A development of the invention is also particularly useful in which a heat conduction compound is provided for improved heat transmission between the temperature sensor and the pump casing. This ensures an appreciably improved transfer of heat to the temperature sensor, in that the direct contact surface between the temperature sensor and the pump casing is supplemented by an additional contact surface via the heat conduction compound. Consequently, the release of the temperature sensor from the direct contact surface on the pump casing due to vehicle vibrations is avoided, so that the operating reliability may be increased appreciably as a result.

In yet a further embodiment of the present invention, the temperature sensor is connected to the pump casing by a silicone adhesive compound. A uniform transfer of heat from the temperature sensor by means of a comparatively large-area heat exchange surface is thereby obtained, with the result that local temperature differences can be compensated and a measurement value deviation prevented. At the same time, simple mounting of the temperature sensor is achieved by gluing the temperature sensor to the pump casing in a suitable position a silicone adhesive compound.

The temperature sensor may be designed as a thermistor with a positive or negative temperature coefficient. As a result, the determination of the temperature and consequently also of the pump feed quantity dependent on this may be achieved without an electronic control unit. The use of a thermistor thereby allows the pump to be used even under difficult circumstances, in which the pump is subjected to high stress such that the use of electronic circuit elements is ruled out. The electric resistance of the thermistor, which is changed due to the respective temperature, therefore directly influences the feed capacity of the pump operated electrically for this purpose.

In another embodiment of the present invention, the pump is equipped with an actuator for regulating the throughflow quantity of the fluid by the fluid temperature detected by the temperature sensor. As a result, when the temperature deviates from a desired value, the fluid may be diverted into another line system to bypass the heating or cooling circuit. The feed quantity of the pump may at the same time be both changed and kept unchanged, and the excess fluid quantity can be used for heating or cooling further components.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
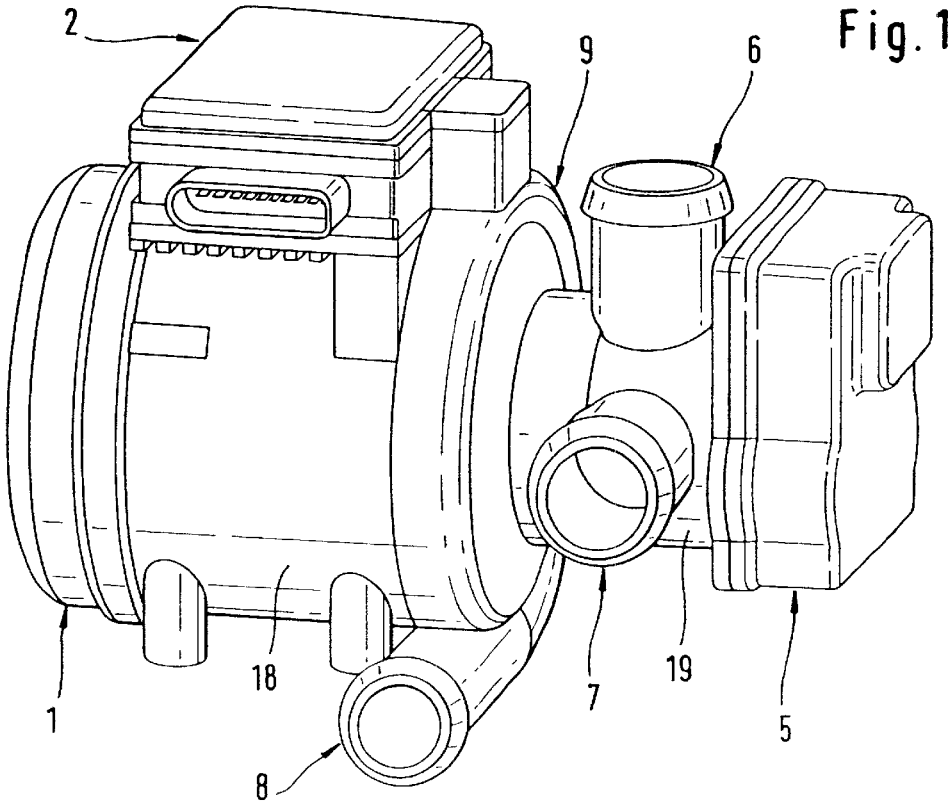
FIG. 1 is a perspective view of a pump according to an embodiment of the present invention.
Figure 2:
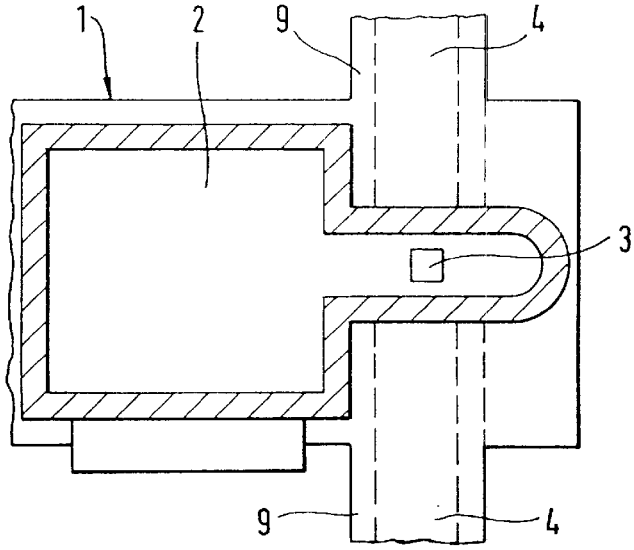
FIG. 2 is a partially sectional top view of the pump of FIG. 1.

FIG. 1 shows a pump 1 designed as a coolant pump for the cooling circuit of an internal combustion engine of a motor vehicle having an electric motor 18 as a drive. A plastic housing 2 for the necessary control electronics is arranged as an integral unit of the pump 1. The plastic housing 2 is mounted on the electric motor 18 and partially covers a pump casing 9. A temperature sensor 3, illustrated in FIG. 2, is arranged in the housing 2 for detecting the temperature of a fluid to be fed and may be designed as a thermistor. Also illustrated in FIG. 1 is an actuator 5 designed as a rotary adjuster for fixing the throughflow quantity and distributing the throughflow quantity to two outlet orifices of a distributor 19 which are designed as connection pieces 6, 7. The pump casing 9 has an inlet orifice 8A designed as a connecting flange 8 which penetrates approximately tangentially into the pump casing 9.

The arrangement of the temperature sensor 3 on the pump 1 is illustrated in FIG. 2 which shows the housing 2 for the control electronics and a partial view of the pump casing 9 in a sectional top view. The position of the temperature sensor 3 is arranged centrally above a pump chamber 4 delimited by the pump casing 9 illustrated merely by broken lines. The transfer of heat from the fluid flowing through the pump chamber 4 to the temperature sensor 3 designed as a thermistor is therefore largely loss-free and is possible without the risk of measurement value deviations.

Figure 3:
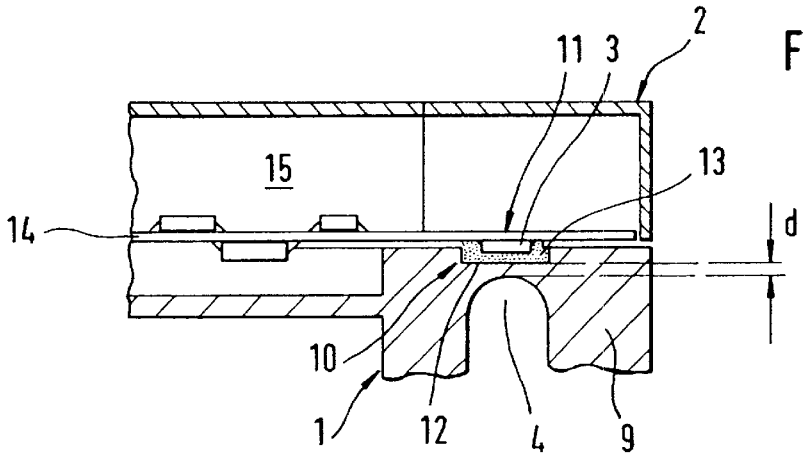
FIG. 3 is a partial sectional side view of the pump of FIG. 1.

To measure the temperature, the temperature sensor 3 is inserted into a recess 10 designed as a depression in the pump casing 9 of the pump 1 (as is illustrated in more detail in FIG. 3). The pump casing 9 has a wall thickness 'd' between the pump chamber 4 and the recess 10, the wall thickness being reduced in a region 11 of the recess 10. The heat transition resistance is reduced by the reduced wall thickness so that the response behavior and the measurement accuracy are further improved. At the same time, in particular, a heat conduction compound 13 fills the recess 10 and thereby widens the contact surface 12 between the temperature sensor 3 and the pump casing 9. The widened contact surface 12 allows a reliable transmission of the temperature to be determined. The temperature sensor 3 is arranged in the housing 2 on a carrier material 14 together with an electronic control 15 of the pump 1. The outlay in terms of production and the operating reliability are thereby improved appreciably, and, in particular, there is no need for the temperature sensor 3 to have additional wiring which is susceptible to faults.

Figure 4:
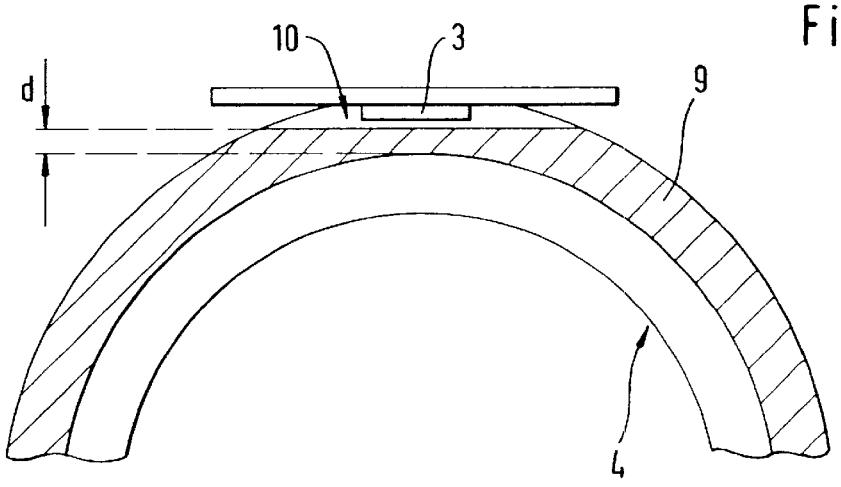
FIG. 4 is a partial sectional front view of a pump according to FIG. 1.

For the sake of clarity, the arrangement of the temperature sensor 3 on the pump casing 9 is additionally illustrated in FIG. 4 which shows a sectional illustration through the recess 10 in a front view of the pump 1. The temperature sensor 3 is inserted directly into the recess 10 designed as a depression. The wall thickness 'd' of the pump casing 9 between the pump chamber 4 and the recess 10 being reduced in the region 11, thereby allowing an improved transfer of heat from the fluid flowing through the pump chamber 4 to the temperature sensor 3.

Figure 5:
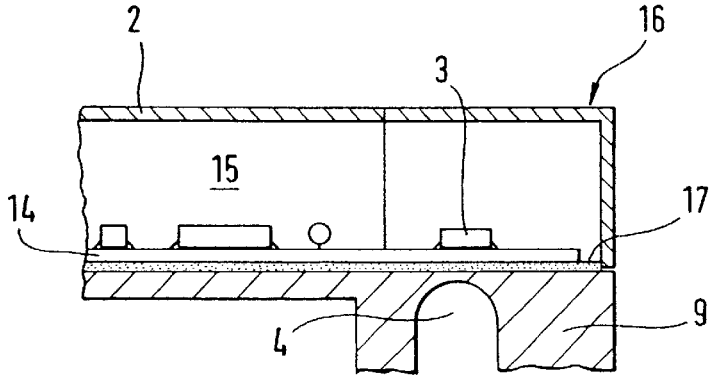
FIG. 5 is a sectional side view corresponding to the view in FIG. 3 of a pump according to a further embodiment of the present invention.

According to a further embodiment, a pump 16 modified in relation to the pump 1 is illustrated in FIG. 5. Here, the temperature sensor 3 is not arranged in a depression. Rather, the temperature sensor is arranged on the outside of the pump casing 9 in the housing 2 of the control electronics of the pump 16. The carrier material 14 common to the control 15 is connected to the pump casing 9 via a silicone adhesive compound 17. The pump 16 may comprise a standard pump retrofitted in a simple way by the exchange of the structural unit consisting of the control 15 and of the temperature sensor 3 and combined in the housing 2. The exchange of the structural unit may be effected without alteration of the pump casing 9 or the pump chamber 4.

Figure 6:
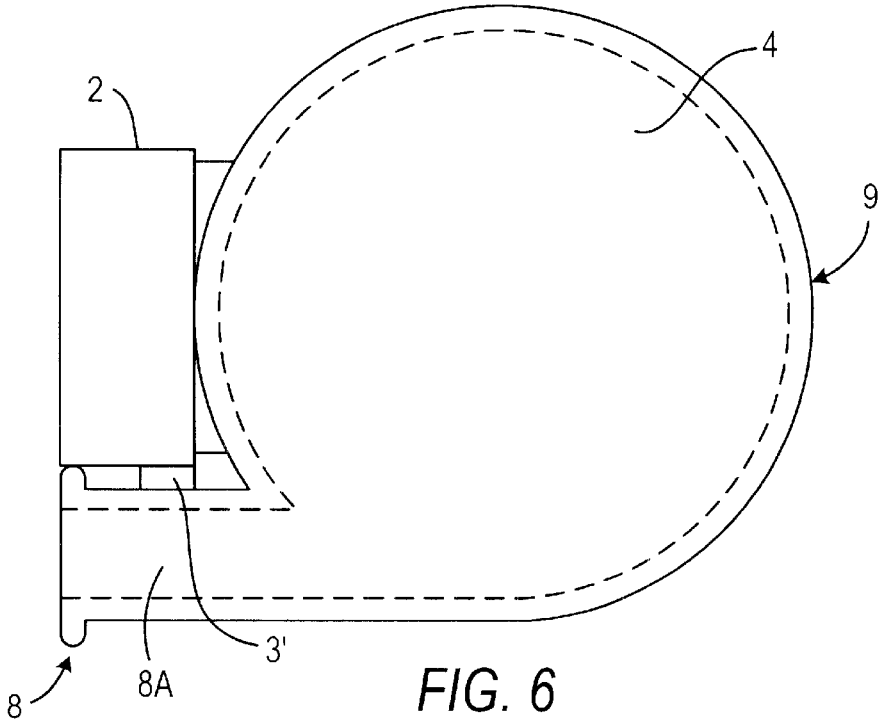
FIG. 6 is a partial sectional front view of a pump according to another embodiment of the present invention.
Figure 7:
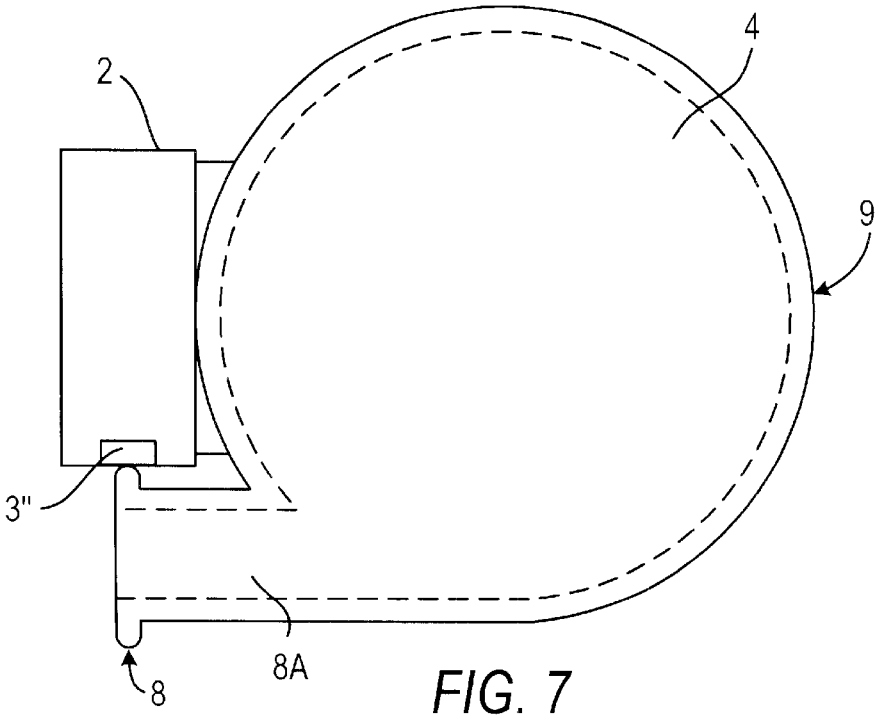
FIG. 7 is a partial sectional front view of a pump according to yet another embodiment of the present invention.

In yet a further embodiment of the present invention shown in FIG. 6, the temperature sensor 3' is arranged in the region of an inlet orifice 8A of the pump chamber 4. This embodiment avoids possible measurement value deviations which may be caused by the pump drive transmitting extraneous heat to the fluid and additionaly avoids any deviations which may arise due to heat possibly being dissipated in the connection region of a line element. As shown in FIG. 7, the temperature sensor 3" is arranged in the region of the connecting flange 8 of the inlet orifice 8A.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A pump arrangement for feeding a fluid, comprising a pump for feeding a fluid and a temperature sensor for directly or indirectly sensing a fluid temperature of the fluid fed by said pump, said pump being operatively arranged for regulating a quantity of fluid of by said pump in response to the fluid temperature detected by said temperature sensor, wherein said pump comprises a pump casing and said temperature sensor is arranged on an outside of said pump casing such that said pump and said temperature sensor comprise an integrated structural unit.

2. The pump arrangement of claim 1, further comprising an electric motor for driving said pump, wherein said temperature sensor is operatively arranged for controlling a rotational speed of said electric motor in response to the fluid temperature detected by said temperature sensor.

3. The pump arrangement of claim 1, wherein said pump casing comprises a reduced wall thickness in a region proximate said temperature sensor.

4. The pump arrangement of claim 1, wherein said temperature sensor is inserted into a recess of said pump casing.

5. The pump arrangement of claim 1, wherein said pump comprises a pump chamber and said temperature sensor is arranged proximate said pump chamber.

6. The pump arrangement of claim 1, wherein said pump comprises a connecting flange, wherein said temperature sensor is arranged proximate said connecting flange.

7. The pump arrangement of claim 1, wherein said pump comprises an inlet orifice and said temperature sensor is arranged proximate said inlet orifice of said pump chamber.

8. The pump arrangement of claim 1, further comprising a controller for controlling said pump, wherein said temperature sensor and said controller are combined as a structural unit.

9. The pump arrangement of claim 8, wherein said temperature sensor is connected to a carrier element produced from a ceramic material.

10. The pump arrangement of claim 1, further comprising a heat conduction compound arranged for improved heat transmission between said temperature sensor and said pump casing.

11. The pump arrangement of claim 1, wherein said temperature sensor is connected to said pump casing via a silicone adhesive compound.

12. The pump arrangement of claim 1, wherein said temperature sensor comprises a thermistor having one of a positive or negative temperature coefficient.

13. The pump arrangement of claim 1, further comprising an actuator for regulating a throughflow quantity of the fluid in response to the fluid temperature detected by said temperature sensor.

* * * * *